United States Patent [19]

Werner

[11] 3,964,387

[45] June 22, 1976

[54] APPARATUS FOR CONTINUOUSLY PRINTING UNCASED FOLDED BOOKS

[75] Inventor: Hans-Dieter Werner, Leipzig, Germany

[73] Assignee: VEB Polygraph Druckmaschinenwerke Leipiz, Leipzig, Germany

[22] Filed: Dec. 11, 1973

[21] Appl. No.: 423,815

Related U.S. Application Data

[62] Division of Ser. No. 285,521, Aug. 31, 1972, abandoned.

[52] U.S. Cl. ..... 101/224; 101/180; 101/247

[51] Int. Cl.[2] ..... B41F 5/06; B41F 13/50

[58] Field of Search ..... 101/120, 199, 180, 247, 101/220, 224, 226; 270/5, 6

[56] References Cited

UNITED STATES PATENTS

| | | | |
|---|---|---|---|
| 1,507,899 | 9/1924 | Tamberlin | 101/199 |
| 2,631,845 | 3/1953 | Zuckerman | 270/5 |
| 2,893,310 | 7/1959 | Johnson | 101/182 |
| 2,928,340 | 3/1960 | Stein et al. | 101/120 |
| 3,072,052 | 1/1963 | Wolff | 101/180 |
| 3,139,025 | 6/1964 | Chambon | 101/247 |
| 3,313,232 | 4/1967 | Van der Winden | 101/118 |
| 3,470,816 | 10/1969 | Piecha et al. | 101/220 |
| 3,527,165 | 9/1970 | Harless | 101/220 |
| 3,540,372 | 11/1970 | Chambon | 101/92 |
| 3,541,953 | 11/1970 | Rochford | 101/92 |
| 3,749,011 | 7/1973 | Abendroth | 101/247 |
| 3,817,174 | 6/1974 | Paulson | 101/247 |

*Primary Examiner*—Edgar S. Burr
*Assistant Examiner*—William Pieprz
*Attorney, Agent, or Firm*—Michael J. Striker

[57] ABSTRACT

A paper web is continuously moved by rotary drive rollers through a series of printing machines having pairs of printing rollers movable between inoperative and printing positions, and controlled and operated so that successive web sections are imprinted by the correlated printing machines only once whereby a plurality of type areas representing printed pages are printed on both sides of each web section in a predetermined pattern. After cutting of the web sections into sheets, and after collecting and folding the sheets, consecutive printed pages follow each other in a folded book.

4 Claims, 6 Drawing Figures

APPARATUS FOR CONTINUOUSLY PRINTING UNCASED FOLDED BOOKS

This is a division of application Serial No. 285,521 filed August 31, 1972 and now abandoned.

BACKGROUND OF THE INVENTION

The present invention relates to a method for continuously printing uncased folded books, and to apparatus serving this purpose. In accordance with the prior art folded books are made, for example, by printing on one or both sides of a web or sheet. The sheets are then cut, folded, and collected in folded condition, and are then stitched or stapled to form an uncased book.

The German Pat. No. 335,110 discloses a rotary printing machine in which several printing plates can be placed on each platen cylinder with the longitudinal direction parallel to the respective cylinder axis. The imprinted web is then longitudinally cut, the cut web portions superimposed, and supplied to a folding apparatus where, in accordance with a number of pages which corresponds to the size of the machine, the sheets are folded to form a book and transversely cut. In the German Pat. No. 485,000, a method for printing books is disclosed, which does not start out from the usual bookbinder sheet, but provides on each sheet the same number of pages. The sheets are then assembled, superimposed, and separated into individual folded books. It is a disadvantage that each sheet of each kind must be first deposited, then assembled, and then cut so that such an arrangement is not suitable for rotary printing machines.

The U. S. Pat. No. 2,463,769 discloses a method for printing of books in which the production is to be increased by putting together a number of longitudinal web portions obtained by longitudinally dividing printed webs so that at the same time, two books can be made. The paper web is first printed by printing plates on which the columns extend in longitudinal direction about the cylinder, whereupon the web is cut into web portions which are superimposed whereupon the web portions are cut into sheets. The sheets are then transversely folded to obtain folded sheets with a predetermined number of pages, whereupon the respective number of folded sheets is assembled, sewn at two opposite edges, so that after binding of the folded sheets and separation of the twice bound folded sheets, two finished books are obtained. This method requires a number of steps which cannot be carried out with rotary printing machines.

The West German Pat. No. 1,107,640 also discloses a method for continuously manufacturing books in which several web portions are superimposed. Particularly for making brochures, two webs are longitudinally cut, the cut web portions superimposed, stapled, and so forth, and then transversely cut and deposited. This method is suitable for rotary printing machines, permits, however, only the manufacture of books having a limited number of pages, as required for school writing books.

Similar methods for making uncased books are disclosed in the British Pat. No. 948,710 in which also two books are manufactured at the same time, and in which the last step of the method is the separation of the two books.

Safety devices are known which automatically stop the printing machine when the web breaks or a sheet is not transported. Such devices operate mechanically or electrically, and it is also known to provide devices in which the machine is automatically stopped if a sheet is omitted, and starts again when the next sheet is supplied. Such a device is disclosed in the German Pat. No. 529,326 in which the stopping and starting of the printing machine is obtained by electromagnets.

Another apparatus which permits an intermittent printing by sheet printing machines, is disclosed in the West German AS No. 1,062,256. This device has the purpose to make any sequence of printed or empty pages by accordingly controlling the starting and stopping of the machine. Such control means are required for the printing of forms so that after the printing of a predetermined number of pages with consecutive numbers, pages can follow which are empty and unnumbered. The publication Pat. No. 1,062,256 uses for the starting and stopping of the printing rollers a mechanical eccentric control device.

Rotary printing machines for color prints are provided with devices for starting and stopping the printing rollers, as disclosed in the DDR Pat. No. 44,672 in printing machines of this kind. After the printing operation of the cylinder of the first printing device, it is necessary that the cylinders of the second printing device become operative only after several revolutions depending on the number of sheets transported between the printing devices. The same procedure must take place when the printing is stopped, and the second printing device must be stopped later than the cylinders of the first printing device by a number of revolutions corresponding to the number of sheets so that all sheets have past the first printing device, and are also imprinted by the cylinders of the second and following printing devices.

The West German AS No. 1,239,322 discloses an apparatus for starting and stopping the blanket cylinders of an offset printing machine. The printing blanket cylinder and the counter blanket cylinder, and also the respective platen cylinders, can be moved between a printing position and an inoperative position. For this purpose the two cooperating blanket cylinders are mounted in eccentric bearings which are angularly displaced by a linkage in such a manner that at the beginning of a printing operation, first the printing blanket cylinder is placed in a position cooperating with the respective platen cylinder, whereupon the counter platen cylinder is in a position cooperating with the respective counter blanket cylinder, whereupon the two blanket printing cylinders are placed in a cooperating position. When the machine is stopped, the two blanket printing cylinders are separated from each other, whereupon each blanket printing cylinder is separated from its associated platen cylinder, and the counter platen cylinder is separated from the associated counter blanket cylinder.

All the devices known for rotary printing machines printing on sheets, cannot be used for rotary printing machines with printing rollers because one blanket printing cylinder must be fixed for receiving the paper sheet.

Finally, the German Pat. No. 419,149 discloses a drive for a rotary offset printing machine with rollers in which by means of one linkage, the two blanket cylinders, which serve as printing cylinders, are moved into contact with the platen cylinders, and away from the same. The distance of displacement is so small that it is not sufficient for an acceptable separation of blanket printing cylinders on both sides of the web.

SUMMARY OF THE INVENTION

It is an object of the invention to provide a very simple method, and a very compact apparatus consisting of few parts, for continuously printing books or brochures at a high productivity.

Another object of the invention is to obtain a continuous production of books by a printing apparatus.

Another object of the invention is to provide a method and apparatus for transforming an unprinted roll of a web into a finished printed and folded uncased book.

Another object of the invention is to provide a printing apparatus for continuously printing on a web so that the imprinted web can be transformed into a folded book.

Another object of the invention is to provide such an apparatus which can also be used for making color prints.

Another object of the invention is to provide a control device by which a pair of cooperating cylinders can be quickly moved between a cooperating printing position, and a spaced inoperative position.

With these objects in view, a paper web is transported through a series of printing machines each of which has a pair of cooperating printing rollers for imprinting both sides of a section of the web with an exact number of pages in a specific pattern, while the imprinted web section is not again imprinted by the printing rollers of the other printing machines, except if a multicolor print is intended. Each following printing machine prints the respective next following number of pages on a sector of the web which was left free by the first preceding printing machine, and the printing machines following the first printing machine so that each printing machine prints only one sector of the web during a cycle for producing one folded book, whereupon the sheets are assembled and folded to form a folded uncased book.

The method of the invention can be applied to rotary offset printing machines, but also to other printing machines which do not operate on the offset printing principle. By selecting a correctly defined number of pages and the sequence of the pages, and by successive imprinting, it is possible to obtain by following rotary folding machines, and longitudinal and transverse cutting devices, a completely printed assembled, folded, and if required also stapled folded book which can be encased.

In accordance with the apparatus of the invention, the printing cylinders or rollers are moved to an operative and inoperative position in a predetermined sequence, and in this sequence, time dependency in relation to the number of printing machines used for each printing operation can be selected wherein the control of the printing cylinders can be carried out by means of electronically controlled devices together with other mechanical, electrical, pneumatic, or hydraulic devices. The printing rollers which cooperate with opposite sides of the web, are controlled by a common control device to move between an inoperative spaced position, and an operative position for imprinting a web section located between the two printing rollers. Both printing cylinders are mounted on angularly displaceable arms which preferably turn about the axes of the respective associated platen rollers, and the arms are connected by two articulated toggle levers whose joint is controlled by a rod reciprocated by a cam so that springs acting on the shafts of the printing rollers can move the printing rollers to the printing position when the rod is retracted and the toggle levers assume an angular position.

However, the arms on which the two printing cyliners or rollers are mounted, may also be turnable about an axis spaced from the axis of the respective associated platen cylinder or roller. It is preferred that the devices for moving the printing cylinders or rollers between the inoperative and operative positions, are disposed at the ends of the cooperating printing cylinders or rollers.

The apparatus of the invention can also be used for making color prints, if the arm means supporting the printing cylinders or rollers are secured so that the printing rollers are always in the printing position. The above described mechanical control device for the printing rollers can be replaced by control devices using electromagnets for operating the printing rollers between inoperative and printing position.

A method of the invention comprises the steps of continuously moving a paper web through a series of printing stations; successively imprinting with different imprints a series of web sections at the printing stations so that the web is cyclically imprinted with series of different imprints; cutting the imprinted web sections into sheets, and assembling and folding the sheets to form an uncased folded book. The imprints are made on both sides of each web section and include a plurality of imprinted areas representing printed pages arranged in a predetermined pattern on each web section so that after cutting, assembling and folding, consecutive printed pages follow each other in the folded book.

An embodiment of the apparatus of the invention comprises a series of printing machines, each including printing roller means, preferably a pair of blanket rollers, located along a path and being movable between an inoperative position and a printing position; rotary transporting means for continuously transporting a paper web along the path so that consecutive web sections cooperate with consecutive printing roller means whereby said printing roller means of each printing machine makes an imprint on a correlated web section when the respective printer roller means is in the printing position, and makes no imprint in the inoperative position; control means for operating each of the printing roller means between the inoperative and printing positions in a predetermined sequence so that each web is imprinted only by the correlated printing roller means with a different imprint; and cutting, assembling, and folding means following the series of printing machines in the direction of the movement of the web for cutting the imprinted web sections into sheets, and for assembling and folding the sheets to form an uncased folded book.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
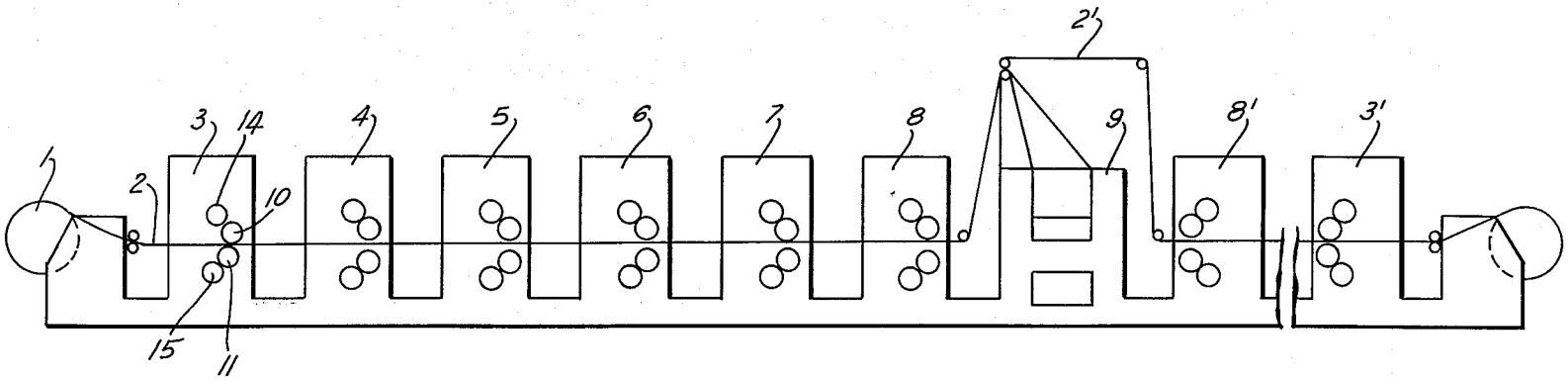
FIG. 1 is a fragmentary schematic side view of an embodiment of the invention including a series of six printing machines.
Figure 2:
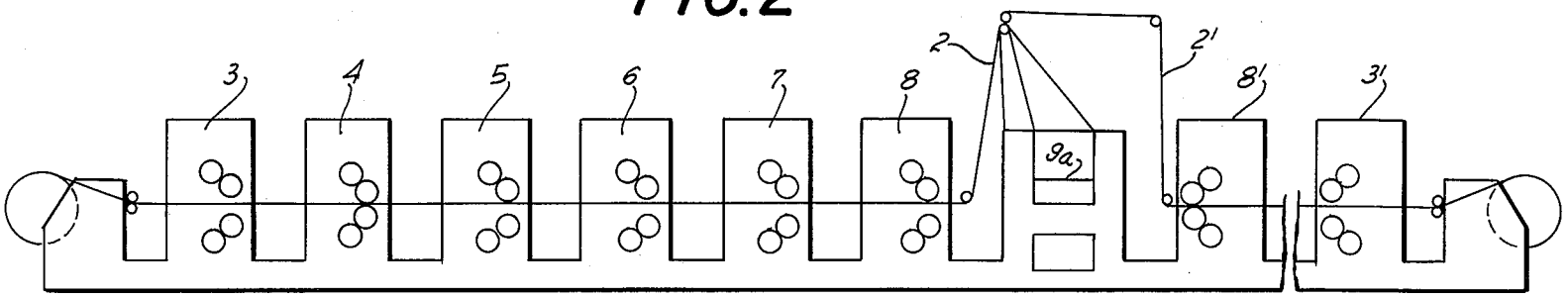
FIG. 2 is a fragmentary schematic side view of the embodiment illustrated in FIG. 1 in a different operational position.

Referring to FIGS. 1 and 2, a paper web 1 is continuously pulled off a supply reel 1 by a rotary drive means 9a forming part of a rotary apparatus 9 including means for longitudinally and transversely folding the web, cutting the web, assembling cut sheets, and stapling or sewing the folded sheets until an uncased folded book is formed. The rotary folding apparatus 9 is conventional, and not an object of the invention.

The paper web 2 is guided over rollers 1a which define a path for the web 2, a great portion of which is straight and horizontal. The web passes through six printing machines 3, 4, 5, 6, 7, 8, each of which has printing roller means including a pair of printing rollers 10, 11, and a pair of platen rollers 14, 15. The printing roller means are operated by a control means, which will be explained hereinafter, to move between an inoperative position in which the printing rollers 10 are spaced, as shown for the printing machines 4 to 8 in FIG. 1, and for printing machines 3 and 5 to 8 in FIG. 2, and a printing position shown in FIG. 1 for printing machine 3, and in FIG. 2 for printing machine 4. In the position of FIG. 1, a sector of the continuously moving web 2 will be imprinted on both sides by the printing rollers 10, 11, but when any other sector passes through the printing machine 3, the printing rollers 10, 11 will be in the inoperative spaced position shown for machine 3 in FIG. 2. An other sector of web 2 is imprinted by the printing rollers 10, 11 of the printing machine 4, as shown in FIG. 2. In accordance with the invention, each of the printing roller means 10, 11 is in contact with the web 2 only for the short period of time required for one revolution of the printing rollers 10 and 11 so that the length of the imprinted sector depends on the diameter of the printing rollers 10, 11, and on the speed of movement of web 2. Immediately after a revolution of a printing roller means 10, 11, the printing rollers 10, 11 are moved to the spaced position shown in FIG. 2 for the printing machine 3, while the printing rollers 10, 11 of the second printing machine 4 are moved to the cooperating printing position shown in FIG. 2 and remain in this printing position for one revolution to imprint another sector of web 2. In FIG. 1, the printing machine 3 is "on" and the other printing machines 4 to 8 are "off", while in FIG. 2, printing machine 4 is "on" and the other printing machines 3 and 5 to 8 are "off". In the illustrated embodiment of the invention, the printing rollers 10 and 11 are offset blanket rollers, respectively cooperating with platen rollers 14 and 15, and it is preferred that the rollers 10 and 11 have twice the diameter of a standard blanket roller to obtain a correspondingly long web section. An exactly defined number of print pages is arranged in a predetermined pattern on the printing cylinders, and the web is imprinted at different sectors with the required number of pages and illustrations during passage through the six printing machines 3 to 8. Evidently, it is not necessary to provide six printing machines, and a different number of printing machines may be used. In an apparatus having six printing machines, as shown in FIGS. 1 and 2, pages 1 to 32 are printed by the printing rollers 10, 11 of the printing machine 3, the pages 33 to 64 are printed by the printing machine 4, and so forth that by each printing machine, 32 pages are imprinted on a web sector, and the last printing machine 8 prints pages 161 to 192.

The web imprinted in this manner on both sides is transported into the rotary folding apparatus 9 of conventional construction, folded first in longitudinal direction, cut into sheets, which are collected, transversely folded and otherwise treated as desired, whereupon the folded pages are stitched or stapled together by a rotary book sewing or stapling apparatus of conventional construction.

In the event that 192 pages are not sufficient, it is possible to simultaneously supply to the machine 9, a second web 2′, schematically shown at the right end of FIGS. 1 and 2. This web passes through a series of printing machines 3′ to 8′ as described above, which produce a corresponding number of pages in the apparatus 9 which can be combined in a book with the pages produced by the printing machines 3 to 8 on the web 2. The web 2′ is guided over rollers and other guide means above the machine 9 to the path of web 2, and the webs 2, 2′ are together guided to the folding devices of the machine 9 in which a second longitudinal folding knife may be provided, and the second series of printing machines 3′ to 8′ may be arranged in a row on the other side of the machine 9 symmetrical to the row of printing machines 3 to 8. It is also possible to arrange an additional row of printing machines parallel to the printing machines 3 to 8. The two imprinted webs in the machine 9 are combined so that up to 384 pages can be imprinted and assembled to form an uncased folded book. In accordance with the capacity of conventional folding machines, further webs may be introduced so that the number of pages could be further increased.

Figure 3:
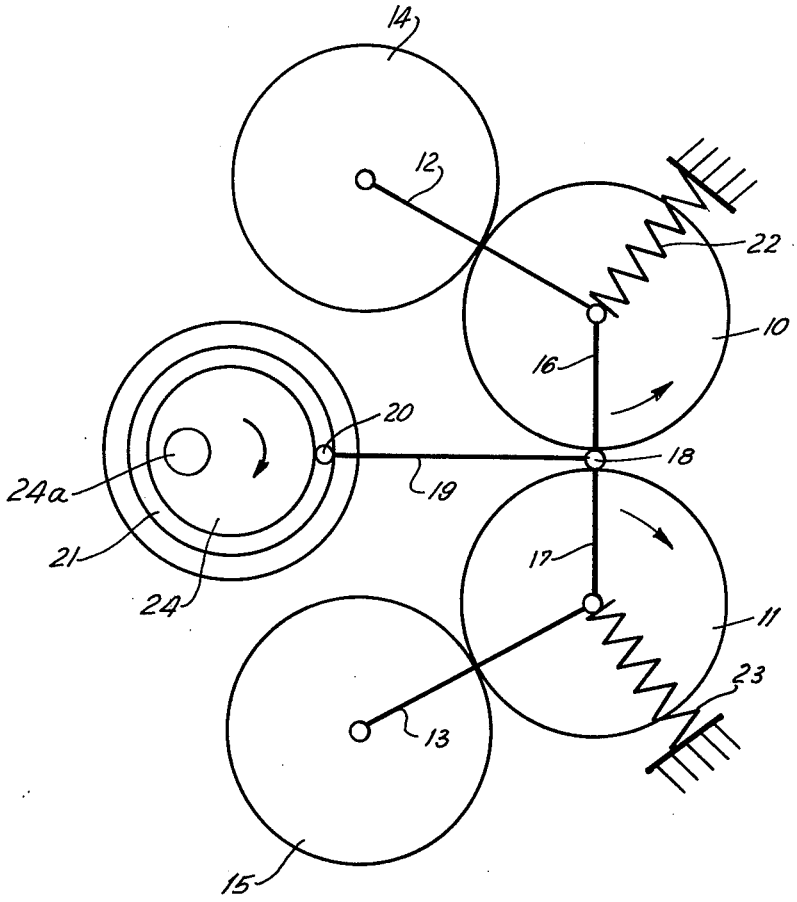
FIG. 3 is a fragmentary schematic side view illustrating a control device for operating the printing rollers of one printing machine between an inoperative and a printing position.

As noted above, the two printing rollers 10 and 11 are offset blanket cylinders, and the two rollers 14 and 15 are platen cylinders respectively cooperating with printing cylinders 10 and 11 which imprint both sides of the respective web section. For shifting the printing roller means between the inoperative position in which printing rollers 10 and 11 are spaced, and the printing position shown for machine 3 in FIG. 1, a control device is provided which is schematically shown in FIG. 3. The blanket cylinders 10 and 11 are rotatably mounted on the outer end of arm means 12 and 13, each of which includes two arms at opposite ends of rollers 14, 10 and 15, 11, respectively. The inner ends of the arm means 12 and 13 are mounted for angular movement about the axes of the correlated platen rollers 14 and 15. However, it is also possible to mount the inner ends of the arm means for angular movement eccentric to the axes of the platen cylinders 14 and 15. The latter construction, not illustrated, is preferred when for particular printing operations, it is advisable to separate not only the blanket cylinders 10 and 11 in the inoperative position, but also to separate the blanket cylinders 10 and 11 from the correlated platen rollers 14 and 15.

Springs 22 and 23 act on the outer ends of arm means 12 and 13, respectively, to turn the arm means 12 and 13 toward each other, but the outer ends of arm means 12 and 13 are connected with each other by toggle levers 16 and 17 which form a toggle joint 18 connected to the outer end of a rod 19. When the toggle levers 16 and 17 are in the illustrated aligned position, the offset rollers 10 and 11 are in a spaced inoperative position so that no imprint is made on the web 2 moving between the blanket rollers 10 and 11, and between the toggle levers 16 and 17 which are positioned at opposite ends of the blanket rollers 10 and 11. The end of rod 19 carries a follower roller 20 guided in a circular cam groove 21 of an eccentric member 24 which is rotated by a shaft 24a so that rod 19 is reciprocated during a revolution of the eccentric member 24, and toggle lever means 16, 17 can be moved to an angular position in which springs 22, 23 urge the offset rollers 10 and 11 to the printing position in which the blanket rollers 10 and 11 roll on opposite sides of the web 2 to imprint web sectors whose length corresponds to the circumferential extension of the blanket rollers 10 and 11. The springs 22 and 23 are selected in order to obtain in a very short time after the buckling of the toggle lever means 16, 17, movements of the offset cylinders 10 and 11 to the printing position in which conventional abutment rings of offset cylinders 10 and 11 engage each other for obtaining imprinting of the web by the offset rollers 10 and 11.

During the time period in which the printing rollers 10 and 11 are to be spaced and inoperative, the eccentric member 24 holds the toggle levers 16 and 17 in the aligned position due to the connection by rod 19 with the toggle joint 18. Evidently, a modification is possible in which the springs urge the shafts of the printing rollers 10 and 11 apart, and in which the operating means 19, 20, 21, 24 effects folding of the toggle levers 16 and 17 for movement of the printing rollers 10 and 11 to the printing position.

Printing cylinders 10 and 11 have shafts, not shown, which are mounted in eccentric bushings within the arm means 12 and 13 so that the usual operations for separating offset blanket rollers 10 and 11 from the platen rollers 14 to 15 can be carried out.

Figure 4:
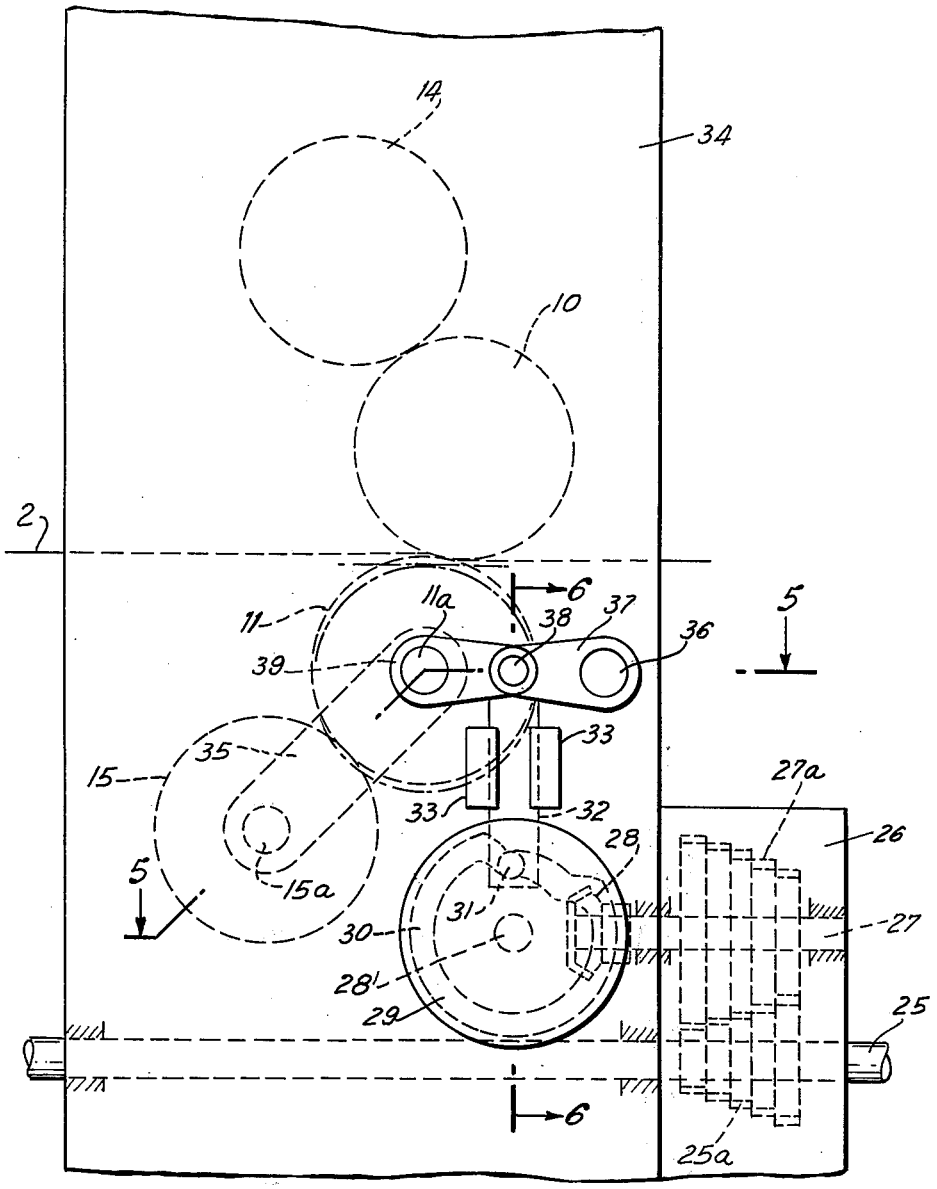
FIG. 4 is a fragmentary side view illustrating a modified control device for operating a printing roller of one printing machine between an inoperative and a printing position.

The number of revolutions of the eccentric member 24 can be varied by exchangeable gears of a gear transmission with the motor, not shown, or by means of a Geneva mechanism, not shown, in a known manner in relation to the number of printing machines which are used, for example six printing machines 3 to 8 in the illustrated embodiment. A transmission 25, 27, 28 as shown in FIG. 4, may be used. Parts 12, 13 and 16 to 24 are provided at both ends of the printing roller means 10, 11, 14, 15. It is also possible to shift only one of the two printing rollers 10, 11 to an inoperative position spaced from the other printing roller. Since the printing roller 11 is located below the printing roller 10, a space between printing rollers 10 and 11 permits the web 2 to sag a little and to separate from the higher printing roller 10 without engaging the lower displaced printing roller 11. In such an arrangement, which is shown in FIGS. 4, 5 and 6, the web 2 engages neither printing roller 10 nor printing roller 11, although only the printing roller 11 is displaced.

Figure 5:
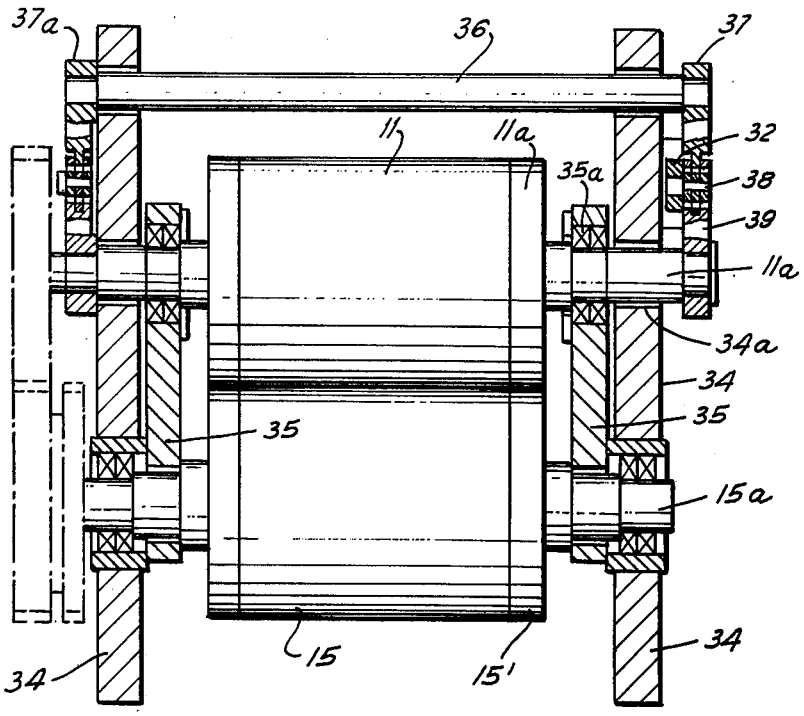
FIG. 5 is a fragmentary sectional view taken on line V—V in FIG. 4.
Figure 6:
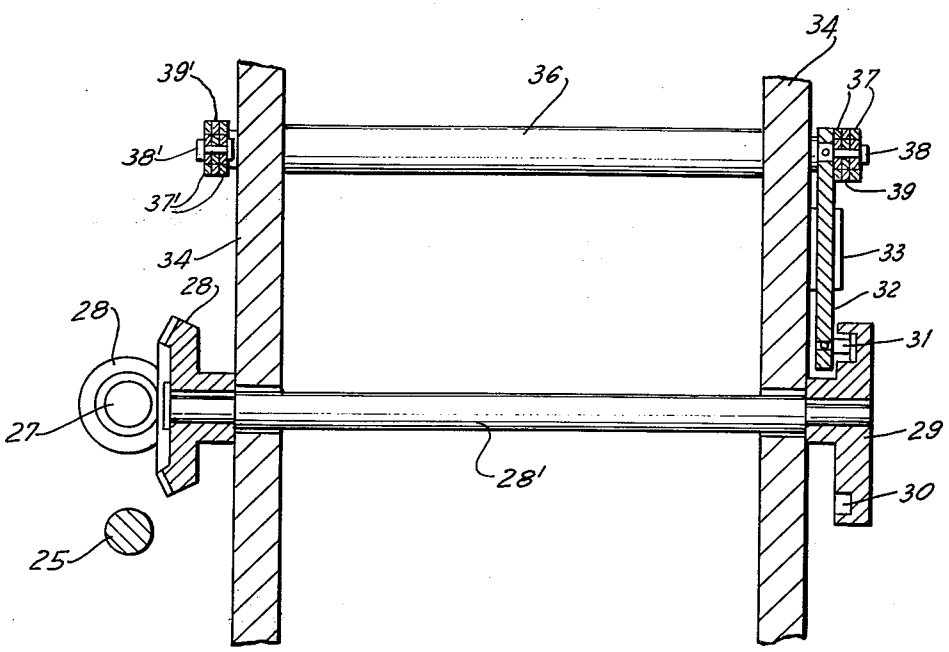
FIG. 6 is a fragmentary sectional view taken on line VI—VI in FIG. 4.

Referring now to FIGS. 4, 5 and 6, the main drive shaft 25 drives a conventional variable transmission 26 in which gears **25*a* of different diameter are secured to shaft 25, while corresponding meshing gears 27*a* are mounted on shaft 27 for rotation. A movable key, not shown, can be used for connecting any one of the gears 27*a* with the corresponding shaft 27 so that the ratio of the transmission is varied. The turning movement of the shaft 27 at the selected speed is transmitted to a bevel gear drive 28 and a shaft 28' to the eccentric member 29 which has an endless cam groove 30 in which a cam follower roller 31 is located. Cam follower roller 31 is connected with a push rod 32 which is guided in guide means 33 for rectilinear movement. Between the two machine walls 34 and 34' and the platen roller 15, two levers 35 and 35' are arranged which support the bearings 35*a* of the printing roller 11, which is a blanket roller, so that the printing roller 11 can swing, within the limits of cutouts 34*a* in wall 34, 34', about the axis of platen roller 15. The shaft end portions 11a of printing roller 11 are located in the cutouts 34a. The shaft 36 is also turnably mounted in the walls 34, 34' and carries outward of walls 34, 34' fixedly secured tiltable levers 37 and 37'. Levers 37, 37' are connected by bolts 38, 38' with a lever 39 or 39', respectively. Levers 39, 39' are turnably mounted on the corresponding ends of the shaft 11a of the printing roller 11. On the operator controlled side of the machine, the guided rod 32 acts by means of bolt 38 in such a manner on the joint connecting levers 37 and 39 that upon a movement of the push rod 32 corresponding to a high point of the cam track 13, lever 39 pulls lever 35 toward the shaft 36, which is due to the fact that the fulcrum of lever 37 is fixed. The bolt 38 is mounted in the push rod 32 as a slide member so that the bolt 38 can remain in lever 37 when the same is turned out of the direction of movement of the guides 33,** while carrying out a small lateral movement.

Since the movement of lever 37 by means of shaft 36 through lever 37' and lever 39' is transmitted to the lever 35', the printing cylinder 11 moves the required distance away from printing roller 10, and releases the web 2 to prevent printing on either side of the web.

When the follower roller 31 engages the lowest point of the cam track 30, the push rod 32 is pulled to a lower position, and the levers 37, 39 and 37', 39' again assume the straightened position, and the levers 35, 35' return to the initial position so that printing takes place.

Depending on the number of printing machines required for a particular operation, the transmission ratio of transmission 26 is selected. The eccentric member 29 with cam track 30 must also be exchanged in accordance with various motions, and therefore is preferably arranged on the operator controlled side of the machine. The exchanging of the eccentric members 29 is necessary, because depending on the number of operative printing machines, the lower cam track portion must be greater or smaller, for example, the cam track portion must extend for an angle of one-sixth of 360° when six printing machines are used, and be staggered from printing machine to printing machine on the respective shaft 28' for an angular distance so that the movement of the printing roller 11 to the printing position takes place at the right moment.

It will be understood that each of the elements described above, or two or more together, may also find a useful application in other types of a method and apparatus for continuously making folded books differing from the types described above.

While the invention has been illustrated and described as embodied in a series of printing machines imprinting different texts on opposite sides of moving web sections, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. Apparatus for continuously printing uncased folded books, comprising a series of printing machines, each printing machine including a printing roller set located along a path and movable between an inoperative position and a printing position; each of said printing roller sets including a pair of printing rollers spaced from each other in said inoperative position, and in contact with opposite sides of said web, respectively, in said printing position so that both sides of each web section are imprinted; transporting means for continuously transporting a length of a paper web along said path so that consecutive web sections cooperate with the printing roller sets of consecutive ones of said printing machines and so that the printing roller set of each of said printing machines makes an imprint on a correlated web section when the respective printing roller set is in said printing position, and makes no imprint when it is in said inoperative position; control means for operating said printing roller sets of the respective printing machines between said inoperative and printing positions in a predetermined sequence so that each web section of said length is imprinted with a different imprint and only by the correlated printing roller set of one of said printing machines but is not imprinted by the printing roller sets of any of the other machines of said series, said control means including a series of control devices operatively connected with said pairs of printing rollers, respectively, for moving said printing rollers between said inoperative and printing positions so that each printing roller is in said printing position during one revolution, each control device including a pair of shafts supporting said printing rollers of each pair of printing rollers, respectively, a pair of arm means pivotally mounted about an axis spaced from the printing cylinders and supporting said shafts for movement with said printing rollers toward and away from each other, a pair of toggle levers having first inner articulated ends located in the plane of symmetry of said each said pair of printing rollers and outer ends connected with said shafts, respectively, and a pair of spring means each acting on one of said outer ends and on said shafts to move said printing rollers to said printing position, said toggle levers having an aligned straight line position spacing said shafts and printing rollers in said inoperative position, and an angular position in which said spring means move said printing rollers to said printing position, and operating means including a cyclically reciprocable rod connected with said first articulated ends for moving said both toggle levers between said aligned and angular position; and cutting, assembling, and folding means following said series of printing machines in the direction of movement of said web for cutting the imprinted web sections into sheets, and for assembling and folding said sheets to form an uncased folded book.

2. Apparatus as claimed in claim 1, wherein said operating means include a cyclically driven rotary means eccentrically connected with said rod for reciprocating said rod.

3. Apparatus as claimed in claim 1, wherein said printing rollers of each pair are offset blanket rollers; and wherein each printing roller set includes two plate cylinders respectively cooperating with said blanket rollers of the respective printing roller set; and wherein said pair of arm means are pivotally mounted for angular movement about the axes of said plate cylinders.

4. Apparatus as claimed in claim 3, wherein said pair of arm means of each control device includes two pairs of arms located at opposite ends of said shafts and supporting said shafts and printing rollers.

* * * * *